United States Patent [19]

Freilich et al.

[11] 4,152,146

[45] May 1, 1979

[54] GLASS-FORMING ALLOYS WITH IMPROVED FILAMENT STRENGTH

[75] Inventors: Alfred Freilich, Livingston; Sheldon Kavesh, Whippany, both of N.J.

[73] Assignee: Allied Chemical Corporation, Morristown, N.J.

[21] Appl. No.: 756,039

[22] Filed: Dec. 29, 1976

[51] Int. Cl.[2] ..... C22C 38/12

[52] U.S. Cl. ..... 75/123 B; 75/123 J

[58] Field of Search ..... 75/123 B, 123 J

[56] References Cited

U.S. PATENT DOCUMENTS

| | | | |
|---|---|---|---|
| 3,856,513 | 12/1974 | Chen et al. | 75/122 |
| 3,871,836 | 3/1975 | Polk et al. | 29/194 |
| 3,986,867 | 10/1976 | Masumoto et al. | 75/126 A |
| 4,036,638 | 7/1977 | Ray et al. | 75/123 B |
| 4,038,073 | 7/1977 | O'Handley et al. | 75/170 |
| 4,067,732 | 1/1978 | Ray | 75/134 F |

OTHER PUBLICATIONS

Business Week, 12/1/73, "New Metals in Search of a Use", pp. 64–65.

*Primary Examiner*—Arthur J. Steiner

*Attorney, Agent, or Firm*—Ernest D. Buff; Gerhard H. Fuchs

[57] ABSTRACT

Replacing iron with small amounts of molybdenum, i.e., about 1 to 8 atom percent, in a glass-forming alloy consisting essentially of about 9 to 24 atom percent boron, the balance essentially iron and incidental impurities, results in substantial improvement in filament strength.

4 Claims, 2 Drawing Figures

GLASS-FORMING ALLOYS WITH IMPROVED FILAMENT STRENGTH

BACKGROUND OF THE INVENTION

1. Field of the Invention

The invention relates to iron-boron glassy metal alloys having improved as-cast filament strength resulting from substitution of iron by molybdenum.

2. Description of the Prior Art

Glass forming metal alloys are conveniently processed in filamentary form by casting and rapid quenching of the melt using processing techniques that are now well-known in the art. The term "filament" is used herein to represent a slender body whose transverse dimensions are much less than its length. In the present context, the filaments may be ribbons, sheets, wires and the like of regular or irregular cross-section.

Glassy metal alloys in wire form have been disclosed in U.S. Pat. No. 3,556,513, issued Dec. 24, 1974 to H. S. Chen et al. These glassy wires have a composition of about 70 to 87 atom percent of at least one transition metal and about 13 to 30 atom percent of at least one element selected from the group consisting of phosphorus, boron, carbon, aluminum, silicon, tin, germanium, indium, beryllium and antimony.

Binary glassy metal alloys consisting essentially of about 75 to 85 atom percent iron or cobalt and 15 to 25 atom percent boron have been disclosed in application Ser. No. 636,323, filed Nov. 28, 1975, now U.S. Pat. No. 4,036,638, issued July 19, 1977. The iron-boron alloys are disclosed as having intrinsic strengths of about 470 to 610 kpsi.

As is well-known, intrinsic strength is measured by hardness and/or tensile testing of carefully polished specimens. For example, in Vol. 9, *Scripta Metallurgica*, pp. 431–436 (1975), it is shown that hardness values determined by a Vickers diamond pyramid indenter can be converted to yield strength, employing a dimensionless conversion factor of about 3.2. However, tests of filaments of the binary iron-boron glassy metal alloys in the as-cast state have invariably exhibited substantially lower tensile strength than the intrinsic alloy strength observed in carefully polished specimens. It appears that filament casting methods may subject the alloy to processing instabilities which are manifested as rough edges and surfaces on the as-cast filaments.

As used herein, the term "as-cast" refers to the state or condition of a filament as it is processed by the casting apparatus. More specifically, the term excludes polishing of the filament, as by mechanical or electrochemical techniques.

SUMMARY OF THE INVENTION

In accordance with the invention, replacement of iron by small amounts of molybdenum in a binary iron-boron glass-forming alloy results in substantial improvement in as-cast filament strength. The composition of glassy alloys formed in accordance with the invention consist essentially of about 1 to 8 atom percent molybdenum, about 9 to 24 atom percent boron and the balance essentially iron and incidental impurities. The compositions of the invention may also be represented as $Fe_{100-y-x}Mo_xB_y$, where B is boron and x and y have the corresponding ranges given above. In addition to the foregoing ranges, the composition of the glassy alloys must be balanced in accordance with the following equation:

$$1.2\times10^4(Mo)+9.3\times10^3(B)-1.4\times10^5(Mo)^2-2.8\times10^4(B)^2\geqq880$$

where (Mo) is the atom fraction of molybdenum and (B) is the atom fraction of boron.

DETAILED DESCRIPTION OF THE INVENTION

The composition of glassy metal alloys formed in accordance with the invention consists essentially of about 1 to 8 atom percent molybdenum, about 9 to 24 atom percent boron and the balance essentially iron and incidental impurities. In addition to the foregoing ranges, the composition of the glassy alloys must be such that the following inequality is satisfied:

$$1.2\times10^4(Mo)+9.3\times10^3(B)-1.4\times10^5(Mo)^2-2.8\times10^4(B)^2\geqq880$$

where (Mo) and (B) are the atom fractions of molybdenum and boron, respectively. Such alloys possess as-cast filament strengths of at least about 300 kpsi. Examples of alloys within the scope of the invention include $Fe_{78}Mo_2B_{20}$, $Fe_{76}Mo_4B_{20}$ and $Fe_{79}Mo_4B_{17}$.

As-cast filament strengths of 400 kpsi or greater are obtained for compositions consisting essentially of about 2.5 to 6 atom percent molybdenum, about 13 to 21 atom percent boron and the balance essentially iron and incidental impurities. In addition to the foregoing ranges, the composition of the glassy alloys must be such that the following inequality is satisfied:

$$1.2\times10^4(Mo)+9.3\times10^3(B)-1.4\times10^5(Mo)^2-2.8\times10^4(B)^2\geqq980$$

Such compositions are preferred.

Maximal as-cast filament strengths are obtained for compositions consisting essentially of about 3.5 to 4.5 atom percent molybdenum, about 16 to 18 atom percent boron and the balance essentially iron and incidental impurities. Such compositions are most preferred.

An expression for the dependence of observed as-cast filament strength T on alloy composition is given as follows:

$$T=-580+1.2\times10^4(Mo)+9.3\times10^3(B)-1.4\times10^5(Mo)^2-2.8\times10^4(B)^2 \quad (1)$$

Figure 1:
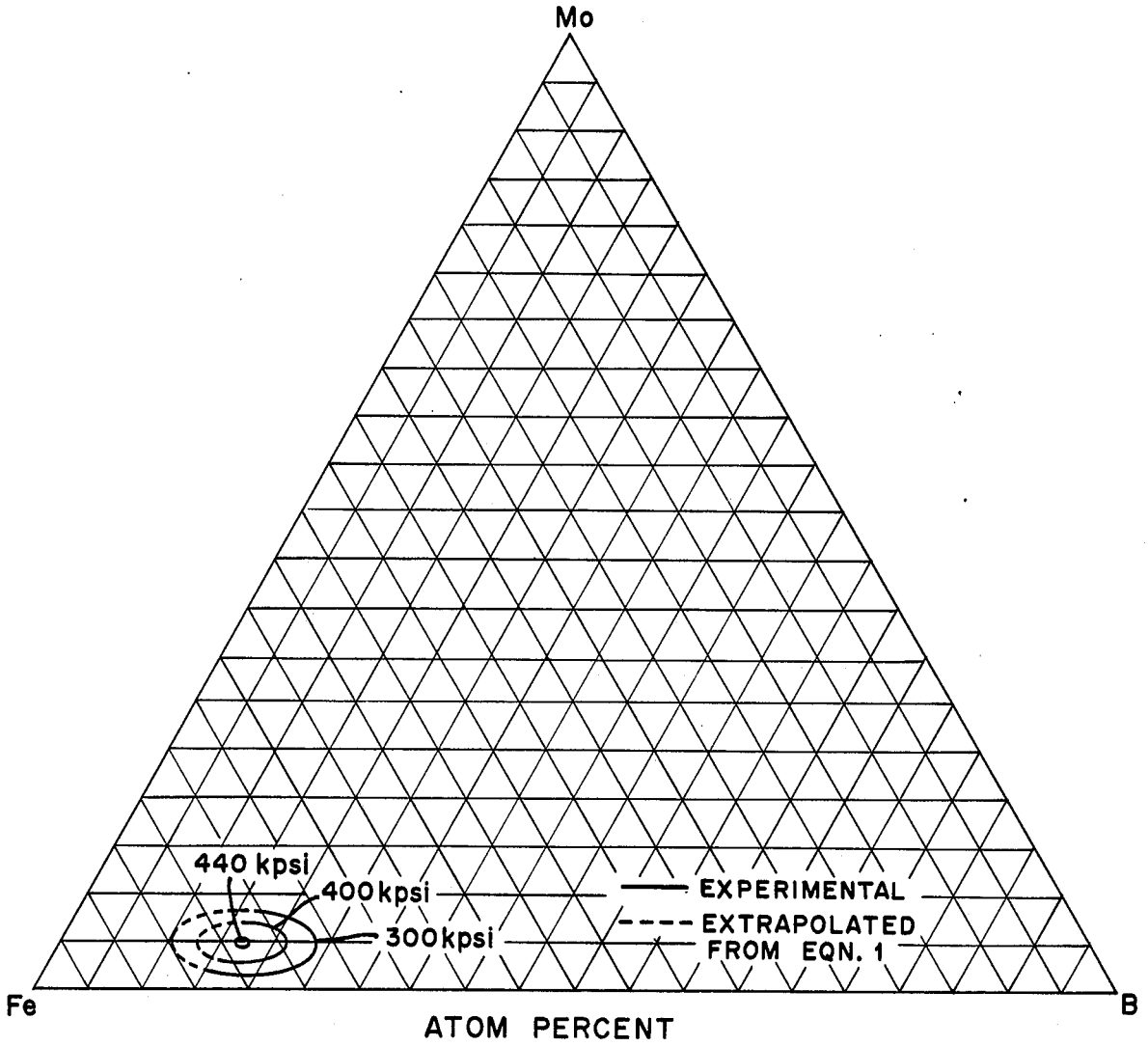
FIG. 1 is ternary composition diagram, in atom percent, of the system Fe-Mo-B, depicting glass-forming composition regions of the invention.

A contour representation of Equation 1 in composition space is presented in FIG. 1. The contours suggest that as-cast filament strength is a mountain arising steeply in a narrow region of the composition plane in the Fe-Mo-B system. The solid lines represent observed values of strength; the dotted lines represent calculated values of strength employing Equation 1.

Figure 2:
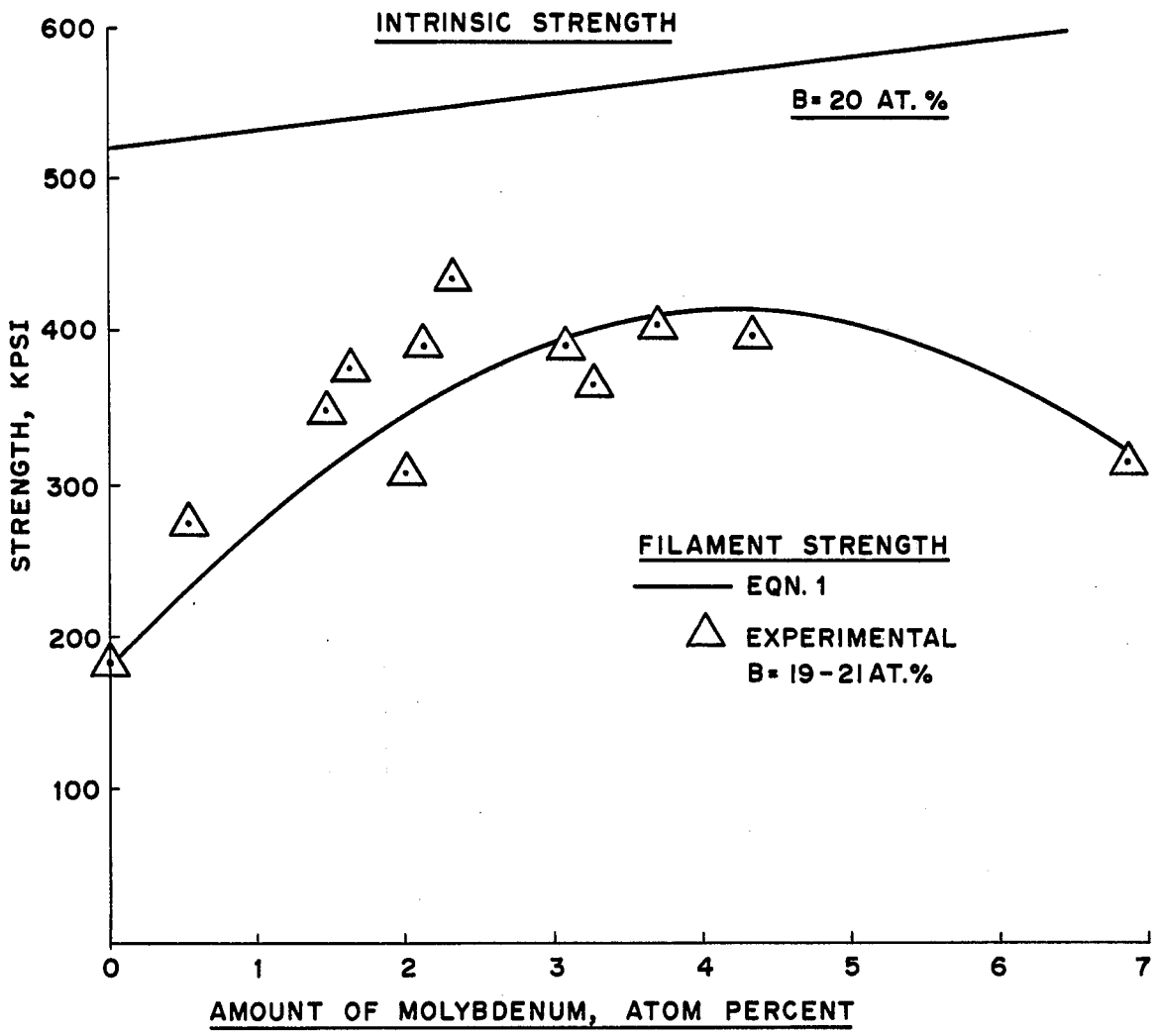
FIG. 2, on coordinates of tensile strength in kpsi and amount of replacement of iron by molybdenum in atom percent in an iron-boron glassy alloy, is a plot of intrinsic strength and as-cast filament strength as a function of molybdenum substitution.

The intrinsic alloy strength and the as-cast filament strength are compared at substantially constant boron content in FIG. 2. It is seen that the substitution of 4 atom percent of iron by 4 atom percent of molybdenum in iron-boron glassy alloys increases the as-cast filament strength more than 100%, whereas intrinsic alloy strength increases less than 10%. This divergence is believed to result from the effect of the presence of molybdenum on processing stability. Even though the as-cast filament strength does not equal the intrinsic strength, the as-cast filament strength is seen to be considerably enhanced from a difference of greater than 300 kpsi below intrinsic strength for an iron-boron glassy alloy without molybdenum substitution to a difference of less than about 150 kpsi below intrinsic strength for an iron-boron glassy alloy in which iron has been replaced by about 4 atom percent of molybdenum.

The compositions of the invention are prepared by cooling a melt of the desired composition at a rate of at least about $10^{5}$° C./sec, employing metal quenching techniques well-known to the glassy metal alloy art; see, e.g., U.S. Pat. No. 3,856,513, discussed earlier. The purity of all compositions is that found in normal commercial practice.

A variety of techniques are available for fabricating continuous filaments, including ribbon, wire and the like. Typically, a particular composition is selected, powders or granules of the requisite elements or of compositions that include the requisite elements, such as ferroboron, are melted and homogenized. The molten alloy is rapidly quenched on a chill surface, such as a rapidly rotating metal cylinder. The alloy produced is substantially glassy, that is, at least about 95% glassy.

EXAMPLES

Filaments of iron-boron alloys that were substantially glassy in which molybdenum was substituted for iron and having dimensions about 0.030 to 0.050 inch wide and about 0.0015 to 0.0025 inch thick were formed by casting a melt of the particular composition by overpressure of argon onto a rapidly rotating copper chill wheel (surface speed about 3000 to 6000 ft/min). The temperature of the melt was about 50° C. above the melting point of the composition. Experimental data for the alloy system $Fe_{100-y-x}Mo_xB_y$ are presented in Table I below. The data consist of x (atom percent of molybdenum), y (atom percent of boron), intrinsic alloy strength (calculated from hardness measurements) in kpsi and as-cast filament strength, T, in kpsi, as measured in tension and as calculated by Equation 1. The difference, Δ, is given in percent. Intrinsic strength was calculated from hardness measurements using a Vickers diamond pyramid indenter. In most cases, the hardness measurements were made on the lateral, or flat, surface of the filament. In a few cases, the hardness measurements were made on the edge of the filament; such compositions so measured are marked with an asterisk. In general, hardness values (edge) are about 15% lower than hardness values (surface). Density was assumed to remain constant for all compositions. A dimensionless conversion factor of 3.2 was employed to calculate the intrinsic strength. The molybdenum content ranged from 0 to 7 atom percent; the boron content ranged from 14 to 25 atom percent.

TABLE I.

| Substitution of Mo in Fe—B Glassy Alloys | | | | | |
|---|---|---|---|---|---|
| x, % Mo | y, % B | Intrinsic Strength, kpsi | T Filament Strength, kpsi Observed | Eqn. 1 | Δ, % |
| Compositions outside the scope of the invention: | | | | | |
| 0 | 17 | 470 | — | 190 | — |
| | 17.1 | 400* | 210 | 190 | 10 |
| | 17.9 | — | 180 | 190 | −5 |
| | 18.1 | — | 170 | 190 | −12 |
| | 18.6 | 480 | 230 | 180 | 22 |
| | 19.2 | — | 190 | 170 | 10 |
| | 20 | 525 | — | 160 | — |
| | 20.2 | — | 120 | 160 | −33 |
| | 22 | 590 | — | 110 | — |
| | 23 | 585 | — | — | — |
| | 24 | 605 | — | 40 | — |
| | 25 | 610 | — | — | — |
| 0.5 | 16.8 | 414* | 270 | 250 | 7 |
| 0.6 | 19.7 | — | 270 | 230 | 15 |
| 0.9 | 20.3 | — | 220 | 250 | −14 |
| 1.4 | 23.0 | — | 250 | 220 | 12 |
| Compositions within the scope of the invention: | | | | | |
| 1.5 | 19.0 | 430 | 350 | 330 | 6 |
| 1.5 | 17.5 | 423* | 340 | 340 | 0 |
| 1.7 | 17.2 | — | 370 | 360 | 3 |
| 1.7 | 19.6 | — | 380 | 330 | 13 |
| 1.8 | 18.8 | — | 390 | 350 | 10 |
| 2 | 20 | 540 | — | 340 | — |
| 2.0 | 19.3 | — | 310 | 360 | −16 |
| 2.0 | 17.6 | 439* | 430 | 380 | 12 |
| 2.1 | 14.0 | — | 350 | 360 | −3 |
| 2.1 | 19.0 | — | 390 | 370 | 5 |
| 2.2 | 17.6 | — | 360 | 390 | −8 |
| 2.4 | 15.9 | — | 430 | 400 | 7 |
| 2.4 | 19.4 | 534 | 440 | 380 | 14 |
| 2.8 | 17.4 | — | 360 | 410 | −14 |
| 2.9 | 18.5 | — | 380 | 410 | −8 |
| 3.1 | 20.2 | — | 390 | 390 | 0 |
| 3.4 | 19.7 | — | 360 | 410 | −14 |
| 3.7 | 20.7 | — | 400 | 400 | 0 |
| 3.8 | 19.1 | — | 440 | 430 | 2 |
| 4 | 20 | 560 | — | 420 | — |
| 4.3 | 19.5 | — | 400 | 430 | −8 |
| 5.9 | 18.7 | — | 440 | 400 | 9 |
| 6 | 20 | 599 | — | 380 | — |
| 7.0 | 19.1 | 480 | 300 | 330 | −10 |

For comparison, the effect of molybdenum substitution in filaments of iron-nickel-boron glassy alloys is presented in Table II. The data consist of the composition in atom percent and the observed as-cast filament strength. The Fe/Ni ratio varied from about 1:2 to 2:1. No systematic improvement in as-cast filament strength was observed with molybdenum substitution in the iron-nickel-boron glassy alloys.

Table II.

| Substitution of Mo in Fe—Ni—B Glassy Alloys. | | | | |
|---|---|---|---|---|
| Composition, atom percent | | | | As-Cast Filament Strength, |
| Fe | Ni | B | Mo | kpsi |
| 27 | 55 | 18 | 0 | 260 |
| 26 | 53 | 18 | 3 | 280 |
| 41 | 41 | 18 | 0 | 350 |
| 39.5 | 39.5 | 18 | 3 | 280 |
| 55 | 27 | 18 | 0 | 320 |
| 53 | 26 | 18 | 3 | 320 |

What is claimed is:

1. A metal alloy that is substantially glassy consisting of about 1 to 8 atom percent molybdenum, about 9 to 24 atom percent boron and the balance essentially iron and incidental impurities having an as-cast filament tensile strength of at least about 300 kpsi, wherein the composition is such that $$1.2\times10^{4}(Mo)+9.3\times10^{3}(B)-1.4\times10^{5}(Mo)^{2}-2.8\times10^{4}(B)^{2}\geqq880$$

where (Mo) is the atom fraction of molybdenum and (B) is the atom fraction of boron.

2. The glassy alloy of claim 1 consisting of about 2.5 to 6 atom percent Mo, about 13 to 21 atom percent boron and the balance essentially iron and incidental impurities having an as-cast filament strength of at least about 400 kpsi, wherein the composition is such that $$1.2\times10^4(Mo)+9.3\times10^3(B)-1.4\times10^5(Mo)^2-2.8\times10^4(B)^2\geqq980.$$

3. The glassy alloy of claim 1 in which the composition consists of 3.5 to 4.5 atom percent molybdenum, 16 to 18 atom percent boron and the balance essentially iron and incidental impurities.

4. The glassy metal alloy of claim 3 consisting of about 4 atom percent molybdenum, about 17 atom percent boron and the balance essentially iron and incidental impurities.

* * * * *